US005281776A

United States Patent [19]

Morel et al.

[11] Patent Number: 5,281,776

[45] Date of Patent: Jan. 25, 1994

[54] MULTIPOLE CIRCUIT BREAKER WITH SINGLE-POLE UNITS

[75] Inventors: Robert Morel, Herbeys; Jean-Pierre Nebon, St. Martin le Vinoux; Jean-Pierre Nereau, Seyssinet-Pariset; Philippe Perrier, Le Touvet, all of France

[73] Assignee: Merlin Gerin, France

[21] Appl. No.: 953,026

[22] Filed: Sep. 29, 1992

[30] Foreign Application Priority Data

Oct. 15, 1991 [FR] France ..... 91 12793

[51] Int. Cl.[5] ..... H01H 9/02; H01H 33/02

[52] U.S. Cl. ..... 200/144 R; 200/145

[58] Field of Search ..... 200/144 R, 145, 50 C, 200/17 R, 18, 307; 335/6-11, 13, 185-204

[56] References Cited

U.S. PATENT DOCUMENTS 4,910,485 3/1990 Bolongeat-Mobleu et al. .... 335/195
5,029,301 7/1991 Nebon et al. ..... 200/144 R X

FOREIGN PATENT DOCUMENTS 0177438 4/1986 European Pat. Off. .
0314540 5/1989 European Pat. Off. .
2108806 5/1972 France .

*Primary Examiner*—J. R. Scott
*Attorney, Agent, or Firm*—Parkhurst, Wendel & Rossi

[57] ABSTRACT

A low voltage multipole circuit breaker having a double housing, each pole including a single-pole breaking unit having a parallelepipedic plastic box having two extended side faces. Contacts are further provided and are associated with an extinguishing chamber housed within the single-pole breaking unit. Several units are mounted side by side in the parallelepipedic box to form a multipole circuit breaker.

10 Claims, 4 Drawing Sheets

MULTIPOLE CIRCUIT BREAKER WITH SINGLE-POLE UNITS

BACKGROUND OF THE INVENTION

The invention relates to a low voltage multipole circuit breaker with double housing, each pole of which comprises a single-pole breaking unit having a parallelepipedic box made of molded plastic material and having two large side faces, and contacts associated with an extinguishing chamber housed in the unit, wherein several units are mounted side by side in a molded case to form the multipole circuit breaker.

A circuit breaker of the kind mentioned comprises for each pole an individual unit formed by a box made of molded plastic material containing the contacts and extinguishing chambers. The advantages of modular systems of this kind are well-known, in particular the reductions in manufacturing and assembly costs. They do however impose constraints as to the respective positioning of the different modules, namely involving the connection between the movable parts of the different single-pole units. A state-of-the-art circuit breaker comprises a rotating shaft which passes through all the single-pole units to drive all movable contacts in rotation simultaneously. The presence of this rotating shaft imposes constraints of positioning and architecture.

SUMMARY OF THE INVENTION

The object of the present invention is to achieve a multipole circuit breaker, of modular type, having a mechanical connection between the single-pole units compatible with the use of a contact bridge.

The circuit breaker according to the invention includes a movable contact which rotates to cooperate with two opposing stationary contacts. The contact bridge is supported by a rotating bar section which extends transversely appreciably in the center of said box between the two large side faces of the box the rotating bar section is able to move in limited translation parallel to these large faces, and the bar sections of the different juxtaposed units are mechanically secured by two parallel connecting bars which extend perpendicularly to the large faces and pass with small clearance through diametrically opposed orifices arranged in the successive bar sections. The two connecting bars are coupled to a crank with two diametrically opposed arms, and an operating mechanism, fixed to the upper part of one of the units, comprises two metal flanges supporting the crank and a bottom connecting rod actuating the crank.

Each single-pole unit forms a breaking assembly housed in an insulating enclosure in the form of a box, and these units are grouped in a second enclosure formed by the case of the multipole circuit breaker. The contact bridge of each single-pole unit is mounted on a bar section and the rigid mechanical connection between the different bar sections is provided by the two connecting bars which extend perpendicularly to the bar, and are eccentric with respect to the rotation axis of the latter.

The bar section is positioned axially by the two large faces of the case located on each side, but it is free to move in the other directions to compensate for the irregularities of manufacturing or positioning. The two diametrically opposed connecting bars fixedly secure the successive bar sections, while leaving the center part of the section free for the passage of the contact bridge. The large faces of the box have openings in the shape of an arc of a circle for connecting bars to pass with clearance, the only other openings being those for outflow of the breaking gas at the rear of the chambers.

According to a development of the invention, the circuit breaker operating mechanism is associated with one of the single-pole units, preferably the center unit, and is arranged to be located on the upper face of the box within the widthwise limits of the box. A mechanism of this kind can, in this case, be used for the whole range of single-pole or multipole circuit breakers, which facilitates the manufacture of such a range of circuit breakers. The mechanism includes a handle, notably pivoting, and operating toggle by rotation of a crank with two diametrically opposed arms. Each crank arm has one of said connecting bars coupled to it to drive the bar sections in rotation.

The mechanism comprises two side flanges each of which supports a crank bearing and these side flanges act as fixing parts to the associated single-pole unit, for example by means of alignment rods, which connect the different single-pole units and spacers. The spacers between two adjacent units ensure modularity between the circuit breakers of a range, i.e. between a single-pole circuit breaker and a multipole circuit breaker, in the manner described in detail in the U.S. patent application Ser. No. 07/952,256, filed Sep. 28, 1992, now pending. The spacer plate presents facing the curved openings of the large side faces of each box, two curved apertures centered on the axis of the bar for the passage of the two connecting bars.

It can be seen that the bar sections are positioned with respect to the mechanism by the connecting bars fixedly secured to the crank, whereas the boxes are positioned by the alignment rods. Manufacturing imperfections are compensated by the small clearance between the bar section and the box. The bar section, of general cylindrical shape and made of insulating material, comprises on the one hand a diametrical aperture through which the contact bridge passes, and on the other hand two angularly offset orifices perpendicular to the aperture for the passage without clearance of the connecting bars which are thus electrically insulated from the contact bridge. The connecting bars pass with clearance through the curved apertures of the large side faces, blanking them off only partially. To achieve an almost tight center part of the box thus favoring displacement of the arc to the extinguishing chambers, the curved apertures are capped by the base of the bar section facing the large face. The tightness can be improved by the insertion of a flexible disk between the base and the large face, the disk being fixedly secured to the connecting bars which pass through it without clearance. When an internal overpressure occurs, the disk is pressed against the large side face sealing off the curved apertures.

In the closed position of the circuit breaker, the contact bridges of the different modular units extend in a plane appreciably parallel to the back-plate of the case and each contact bridge cooperates on the one hand with a stationary contact located above this plane and on the other hand on the opposite side with a stationary contact located below this plane. Each stationary contact is connected to a connecting terminal strip, and the terminal strip connected to the stationary contact located below the plane is near the front face of the box, whereas the terminal strip connected to the other stationary contact is near the back-plate of the box. This arrangement gives the single-pole unit a certain symmetry and facilitates connection of a trip unit which can be either incorporated in the circuit breaker case or be adjoined to the small side face of the circuit breaker case. The trip unit is common to the different single-pole units, but it is conceivable to achieve modular systems each associated with one of the single-pole units. The trip unit is located on the terminal strip side on the front face of the single-pole units.

The modularity of the system enables a range of circuit breakers to be achieved from a limited number of sub-assemblies. The system is particularly simple and the double enclosure and double breaking give it remarkable performance.

BRIEF DESCRIPTION OF THE DRAWINGS

Other advantages and features will become more clearly apparent from the following description of an illustrative embodiment of the invention, given as a non-restrictive example only and represented in the accompanying drawings in which.

DESCRIPTION OF THE PREFERRED EMBODIMENT

Figure 1:
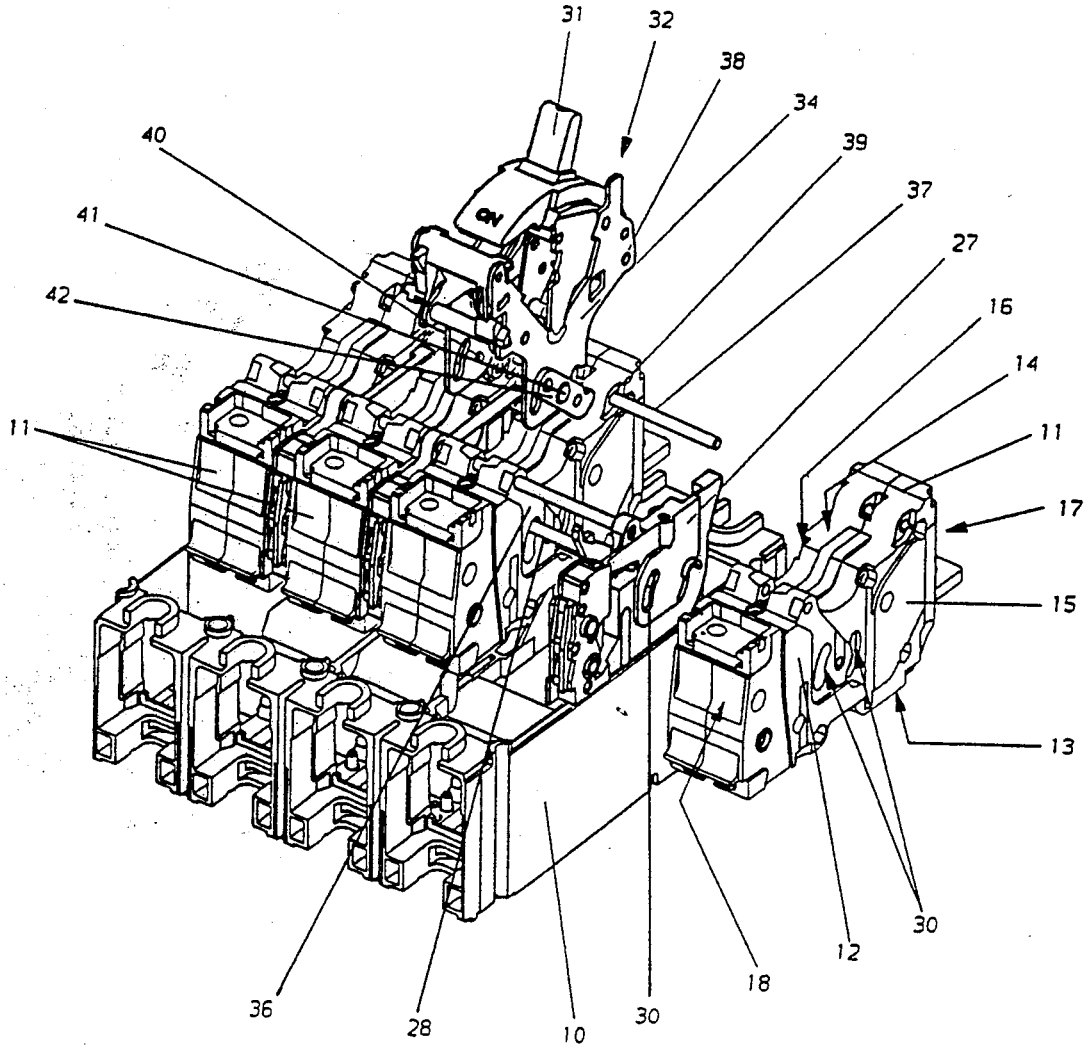
FIG. 1 is a schematic exploded perspective view of a circuit breaker according to the invention.
Figure 2:
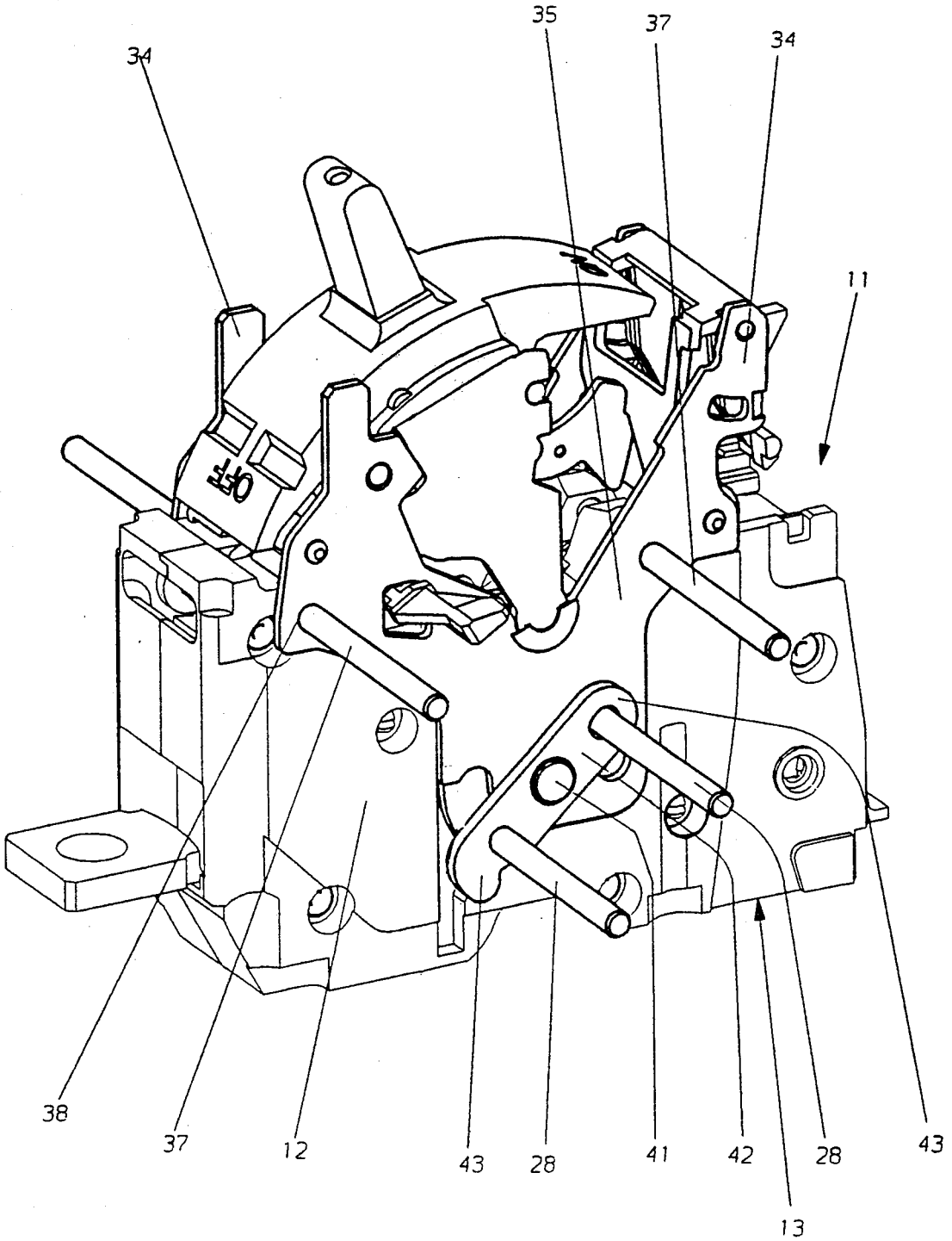
FIG. 2 is an enlarged scale perspective view of a single-pole unit and of the associated operating mechanism of the circuit breaker according to FIG. 1.
Figure 3:
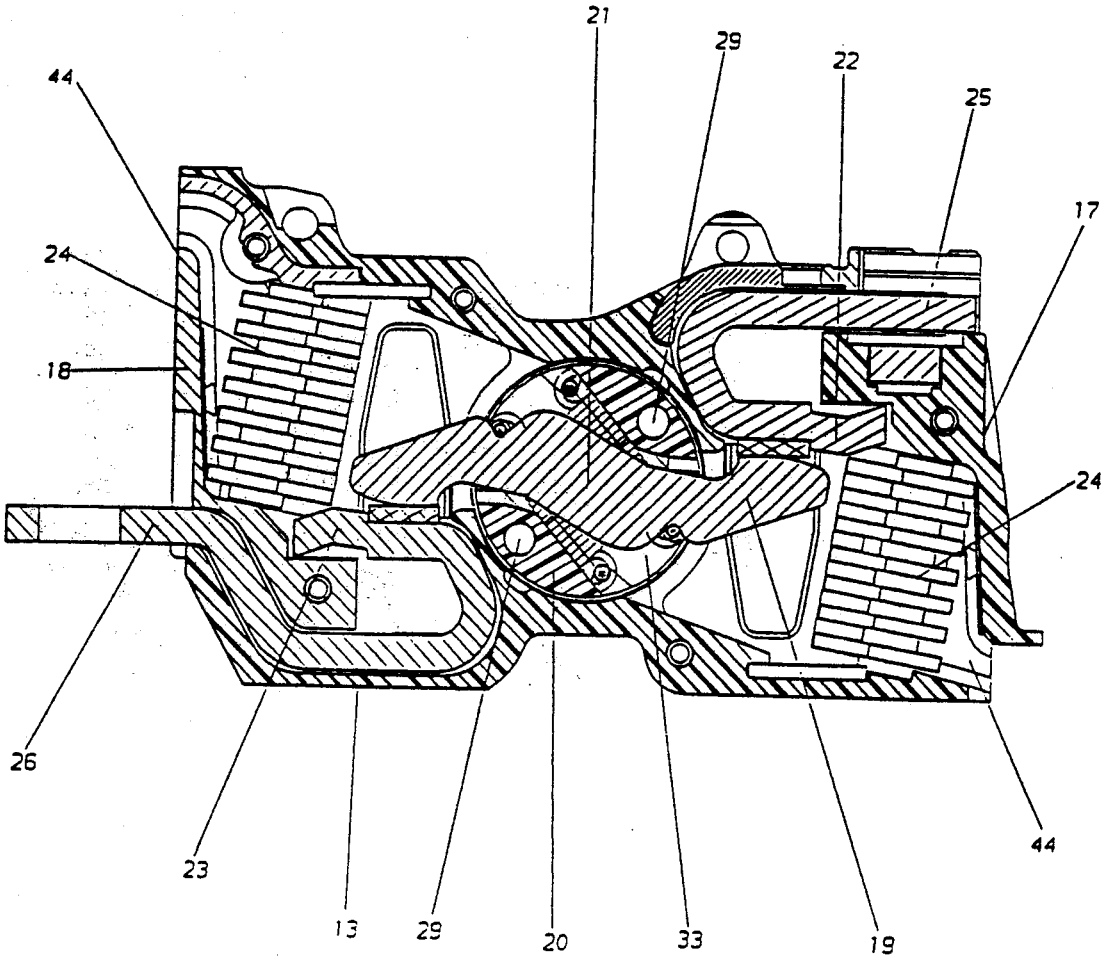
FIG. 3 is a cross sectional view of the single-pole unit.

In the drawings, a molded case multipole circuit breaker 10 comprises four single-pole units 11 of general parallelepipedic shape, arranged side by side in the case 10. Each single-pole unit comprises a box 12 made of molded plastic material having a back-plate 13, a front face 14, two parallel large side faces 15,16 and two parallel small side faces 17,18. Inside the box 12 there is housed a contact bridge 19, supported by a bar section 20 extending perpendicularly to the large side faces 15,16. The movable contact bridge 19 cooperates on one side with a stationary contact 22, and on the opposite side with a stationary contact 23, and each pair of contacts 19,22;19,23 has associated with it an extinguishing chamber 24 with ionization plates. The movable contact bridge 19 is mounted on the bar section 20 by means of two opposing springs in the manner described in detail in U.S. Pat. No. 4,910,485. The rotation axis 21 of the contact bridge 19 is appreciably in the center of the box 12, and in the closed position the contact bridge 19 extends in a mid-plane appreciably parallel to the back-plate 13 of the box 12. The stationary contact 22 is located above this mid-plane, and is connected to a contact terminal strip 25, near the front face 14 of the box 12. The other opposing contact 23 is symmetrically located below this mid-plane, and is connected to a terminal strip 26 near the back-plate 13 of the box 12.

The single-pole unit 11 is an independent unit forming one of the circuit breaker poles, and the association of several single-pole units enables a multipole circuit breaker to be achieved. The single-pole units are adjoined by their large side faces 15,16, with a spacer plate 27 disposed within a gap between the successive units. The bar sections 20 of the different single-pole units 11 are mechanically connected by two connecting bars 28 which extend parallel to the rotation axis 21, and which pass without clearance through orifices 29 arranged in the bar sections 20. The connecting bars 28 are eccentric with respect to the rotation axis 21, and the large side faces 15,16 and spacer plates 27 have elongated apertures 30 of curved shape for the connecting bars 28 to pass through with clearance with a possibility of movement suited to the rotation movement of the bar sections 20.

The bar section 20, in the form of a cylindrical stub made of insulating material, is framed laterally with small clearance by the two large faces 15,16, but is free to move slightly in the other directions to compensate for irregularities of manufacturing or positioning. The contact bridge 19, in the form of a bar, passes through an aperture 33 arranged according to a diameter in the bar section 20 and this aperture 33 is angularly offset with respect to the orifices 29 for the passage of the connecting bars 28 perpendicular to the contact bridge 19.

On the front face 14 of one of the center single-pole units 11, there is fixed a standard type mechanism 32 having an operating handle 31 and a toggle. The mechanism 32 comprises two external metal flanges 34, extending in parallel and separated by a distance corresponding appreciably to the width of the single-pole unit 11. These flanges 34 are fixed, at their bottom part 35, to the single-pole unit 11 by alignment rods 37 which extend perpendicularly to the large faces 15,16 and pass through aligned orifices 38,39 respectively of the flanges 34 and boxes 12. Each flange 34 supports a bearing 40 of a crank 42 with an axis 41 controlled by the mechanism 32 to perform an alternate limited rotation respectively for opening and closing of the circuit breaker. Each crank 42 comprises two opposing arms 43, each having one of the connecting bars 28 passing through it without clearance. Rotation of the cranks 42 is transmitted via the two bars 28, which move in the curved apertures 30, to the different bar sections 20 to open and close the contacts 19,22, 23.

The mechanism 32 is common to all the single-pole units 11, and this mechanism is housed in the case 10, only the handle 31 being accessible from outside for operation of the circuit breaker. The bars 28 form a rigid connection between the sections 20 which form a bar articulated by the bearings 40 on the two flanges 34. Positioning or manufacturing imperfections do not affect movement of the contact bridge 19 guided by the bar section 20, the latter being mounted with clearance in the box 12. A whole range of molded case circuit breakers can be built up from standard single-pole units 11, the double enclosure formed by the box 12 and case 10, and the floating assembly of the contact bridge 19 guaranteeing remarkable performance of the circuit breaker.

Figure 4:
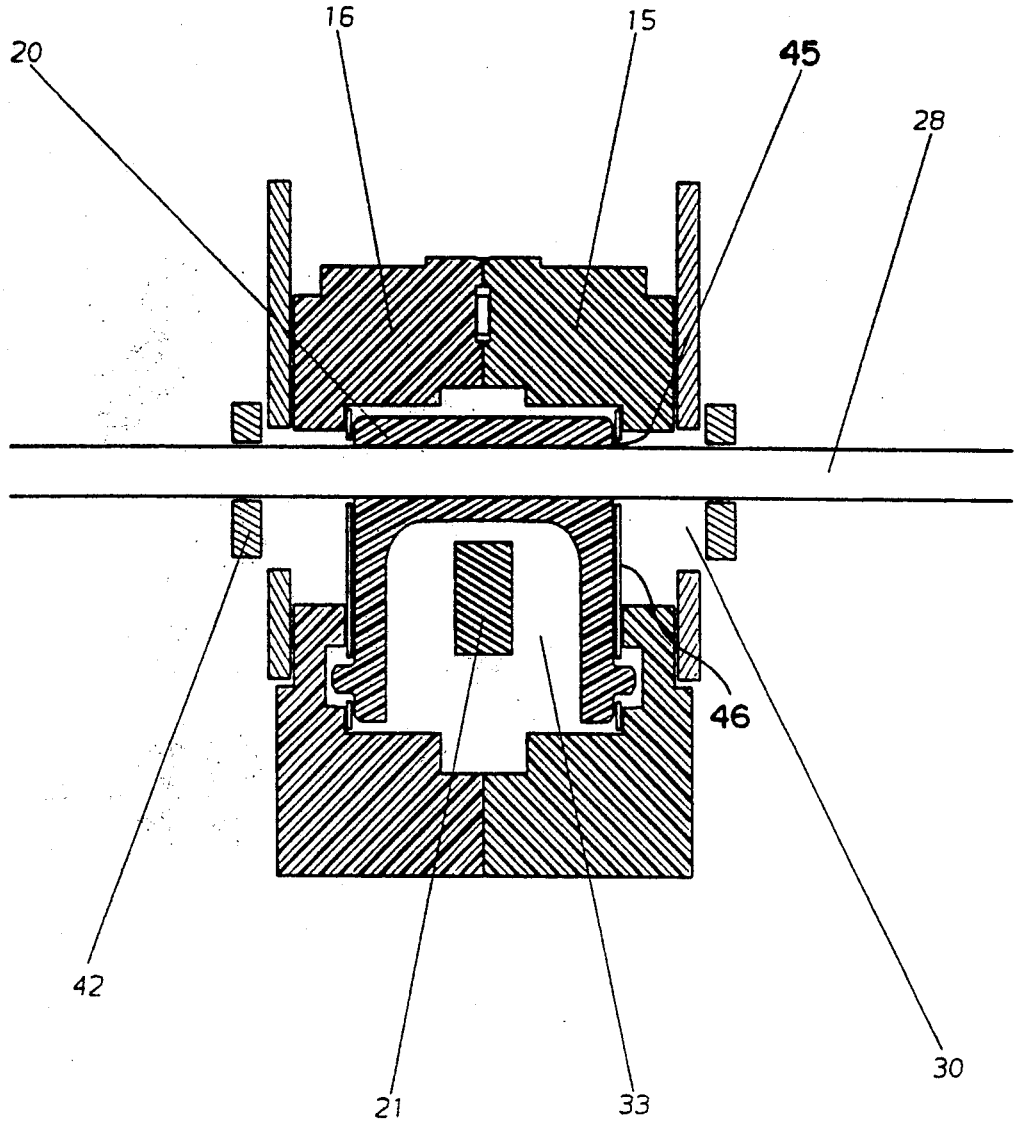
FIG. 4 is an axial section view of the bar section, showing the sealing valves.

The circuit breaker comprises a trip unit (not shown) which is either incorporated in the case 10 or adjoined to the small external face of the latter. The trip device, of the electronic or electromechanical type, can be common to all the single-pole units 11, or possibly be of the modular type, associated with each pole unit 11. At the rear of the extinguishing chambers 24 there are provided openings 44 for outflow of the breaking gases to the outside of the box 12, the only other openings in the latter being the curved apertures 30 for the connecting bars 28 to pass through. The quasi-tightness of the box 12, notably in its center part, enhances breaking, the arc being blown towards the extinguishing chambers 34. Referring to FIG. 4, it can be seen that this tightness is improved by the small clearance between the front part 45 of the bar section 20 and the internal surface of the large face 15,16. According to a development of the invention, a flexible disk 46 is inserted between the bar section 20 and the large face 15,16 facing the curved apertures 30. The disk 46 operates as a valve which is pressed against the faces 15,16 when an internal overpressure occurs to seal off the apertures 30. The connecting bars 28 pass with small clearance through holes arranged in the disk 46 which moves with these bars. Other sealing means, for example by slide valve, are envisageable.

The invention is naturally in no way limited to the embodiment more particularly described.

We claim:

1. A low voltage multipole circuit breaker, comprising:

a plurality of single-pole breaking units, each single-pole breaking unit comprising (a) a parallelepipedic box comprised of a molded plastic material, said box having two opposite large side faces, (b) two opposing stationary contacts housed within said box, said stationary contacts being spaced apart from each other, (c) a rotating contact bridge rotatable between a first position to be in contact with said stationary contacts and a second position to be separated from said stationary contacts, and (d) a rotating bar section which supports said contact bridge, said bar section extending transversely between said two opposite large side faces, said bar section comprising two opposite axial orifices extending therethrough, said axial orifices being eccentric to the axis of rotation of said rotating bar section;

a molded case for housing said single-pole breaking units, said single-pole breaking units being arranged side by side in said molded case;

two parallel connecting bars extending respectively through said two opposite axial orifices to interconnect adjacent single-pole breaking units;

an operating mechanism onto one of said single-pole breaking units, said operating mechanism comprising two opposing metal flanges and a switch device disposed between said metal flanges and secured to a crank to drive said crank in rotation about a crank axis, said crank being pivotally mounted on said metal flanges and having two opposite arms respectively coupled to said two parallel connecting bars to simultaneously operate said single-pole breaking units by simultaneously rotating each contact bridge.

2. The circuit breaker of claim 1, wherein said two opposing metal flanges are separated from each other a distance substantially equal to the width of said one of said single-pole breaking units, said width being defined by the two opposite large side faces.

3. The circuit breaker of claim 1, wherein said two opposite large side faces have curved apertures through which said two connecting bars extend to allow rotational displacement of the connecting bars.

4. The circuit breaker of claim 3, wherein the bar section is housed within the box and outer side surfaces of the bar section sealed off said curved apertures to yield a substantially leaktight box.

5. The circuit breaker of claim 4, further comprising a flexible disc positioned between each outer side surface of the bar section and said box, said flexible disc being fixedly secured to said connecting bars and substantially covering said curved apertures to thereby seal off said curved apertures.

6. The circuit breaker of claim 1, further comprising spacer plates inserted between adjacent single-pole breaking units, and alignment rods passing through adjacent single-pole breaking units and the spacer plates to fixedly secure the single-pole breaking units and the spacer plates to each other.

7. The circuit breaker of claim 6, wherein the alignment rods tightly pass through holes in the metal flanges of said operating mechanism.

8. The circuit breaker of claim 1, wherein the switch device comprises a manual operating handle, said molded case having an aperture therein for passage of said operating handle therethrough.

9. The circuit breaker of claim 1, wherein said bar section is comprised of an insulating material having an open portion for receiving said contact bridge therein.

10. The circuit breaker of claim 1, wherein said crank comprises two crank elements respectively pivotally mounted on said two metal flanges, said two connecting bars passing through each bar section and each of said two crank elements.

* * * * *